US006179670B1

(12) United States Patent
Sugiyama

(10) Patent No.: US 6,179,670 B1
(45) Date of Patent: Jan. 30, 2001

(54) CONNECTOR HAVING A POSITION REGULATING STRUCTURE

(75) Inventor: Osamu Sugiyama, Shizuoka-ken (JP)

(73) Assignee: Yazaki Corporation, Tokyo (JP)

( * ) Notice: Under 35 U.S.C. 154(b), the term of this patent shall be extended for 0 days.

(21) Appl. No.: 09/200,942

(22) Filed: Nov. 30, 1998

(30) Foreign Application Priority Data

Dec. 1, 1997 (JP) ..... 9-330646

(51) Int. Cl.[7] ..... H01R 13/502
(52) U.S. Cl. ..... 439/701
(58) Field of Search ..... 439/701, 345, 439/350, 598, 374, 597–601

(56) References Cited

U.S. PATENT DOCUMENTS 4,998,889 * 3/1991 Moly ..... 439/247
5,190,476 3/1993 Chaillot .
6,017,250 * 1/2000 Tsuji et al. ..... 439/701

FOREIGN PATENT DOCUMENTS 0 817 320 A2 7/1997 (EP) .
10-21993 1/1998 (JP) .

* cited by examiner

*Primary Examiner*—Khiem Nguyen
*Assistant Examiner*—Son V. Nguyen
(74) *Attorney, Agent, or Firm*—Finnegan, Henderson, Farabow, Garrett & Dunner, L.L.P.

(57) ABSTRACT

Plural sub-connectors (13), where terminal housing chambers (29) for housing terminals (21) are formed, are inserted into a holding member (12). A position regulating structure (36) is formed by rib sections (37) on inner surfaces of the holding member (12) and groove (38) sections of the male sub-connectors, the positions of the male sub-connectors are regulated and the male sub-connectors (13) are fixed so that mating terminal insertion openings (30) of the male sub-connectors (13) and mating terminal insertion openings (19) of the holding member (12) coincide with each other.

20 Claims, 4 Drawing Sheets

CONNECTOR HAVING A POSITION REGULATING STRUCTURE

BACKGROUND OF THE INVENTION

1. Field of the Invention

The present invention relates to a connector in which plural male sub-connectors are mounted to a holding member so as to be connected collectively.

2. Description of the Related Art

A conventional connector disclosed in Japanese Patent Application No. 8-175161 is constituted so that plural male sub-connectors are mounted into a holding member.

The holding member is formed in a rectangular box shape, and the male sub-connectors are inserted into the holding member from its backward portion so as to be mounted. The male sub-connectors are arranged in two files in the vertical direction and in three ranks in the horizontal direction. Namely, the six male sub-connectors are mounted into the holding member. Moreover, tapered mating terminal insertion openings, into which mating terminals are inserted, are formed on a front surface of the holding member so as to form lines correspondingly to the male sub-connectors. This holding member is formed by injecting resin into a cavity of a metal mold.

The male sub-connector has a rectangular box-shaped connector housing whose back portion is opened. Two upper and lower terminal housing chambers for housing terminals are formed in the connector housing, and the terminals are inserted respectively into the terminal housing chambers from the back portion of the connector housing with the terminals being connected with electric wires. Terminal insertion openings, which are interconnected with the terminal insertion openings of the holding member, are formed on the front surface of the connector housing.

The terminals are formed by interconnecting caulking sections for caulking and fixing insulating coating of the electric wires, connection sections to be connected with conductors of the electric wires and contact sections which are electrically connected by contacting with mating terminals. The terminals are inserted into the terminal housing chambers of the male sub-connector from the contact sections. The contact sections have a tubular shape, and the mating terminals are inserted from openings at their points thereinto. For this reason, the openings are interconnected with the mating terminal insertion openings of the male sub-connectors and the mating terminal insertion openings of the holding member. Moreover, contact pieces, which elastically contact with the mating terminals inserted from the openings, are provided in the contact sections.

Such a connector is assembled so that the male sub-connectors through which the terminals were inserted are inserted into the holding member, and the connector in this assembled state is fitted into a mating connector. As a result, mating terminals of the mating connector are inserted through the mating terminal insertion openings and of the holding member and the male sub-connectors. The mating terminals are inserted from the openings of the terminals into the contact sections so as to contact with the contact pieces in the contact sections, and as a result, the terminals are connected with each other.

In the aforementioned connector, since the holding member which was injection-molded is rapped from a metal mold, it is necessary to provide a trimming taper on the inner surface of the holding member. Further, as the holding member becomes longer towards an insertion direction of the male sub-connector, namely, its depth becomes larger, and a taper angle θ of the trimming taper should be set to a larger value.

However, when the trimming taper angle θ becomes larger, the point of the male sub-connector is separated from the inner surface of the holding member. For this reason, the male sub-connector becomes unstable while in the holding member. Due to the unstable male sub-connector, the terminals in the male sub-connector are shifted from the holding member. As a result, since the wall of the terminals come into the mating terminal insertion openings of the holding member, the mating terminals to be inserted from the mating terminal insertion openings bump into the points of the walls in the terminals. For this reason, proper contact with the mating terminals cannot be obtained, namely, there arises a problem of improper contact.

SUMMARY OF THE INVENTION

It is therefore an object of the present invention to provide a connector in which even if a trimming taper of a holding member becomes larger, male sub-connectors can be mounted stably, and as a result, the walls of terminals in the male sub-connectors do not come into mating terminal insertion openings in the male sub-connectors so that satisfactory contact with mating terminals can be obtained.

To achieve the above object of the present invention, there is provided a connector comprising:

a plurality of male sub-connectors in which terminal housing chambers for housing terminals are formed;

a holding member into which the male sub-connectors are inserted; and position regulating means for regulating positions of the male sub-connectors and fixes the male sub-connectors so that mating terminal insertion openings of the male sub-connectors coincide with mating terminal insertion openings of the holding member, the position regulating means being provided on outer surfaces of the male sub-connectors and an inner surface of the holding member.

The position regulating means of the present invention regulates the positions of the male sub-connectors so that the mating terminal insertion openings of the male sub-connectors coincide with the mating terminal insertion openings of the holding member. The regulation eliminates the unstable state of the male sub-connectors, and the terminals in the male sub-connectors do not come into the diameter of the mating terminal insertion openings of the holding member. For this reason, the mating terminals are inserted into the terminals securely, and thus stable connection can be made.

In addition, since the position regulating means regulates and fixes the positions of the male sub-connectors, the plural sub-connectors can be securely housed in the prescribed positions in the holding member. For this reason, in the case where the male sub-connectors are piled in the vertical direction, it is not necessary to form partition walls for separating the upper and lower male sub-connectors in the holding member. Therefore, the structure of the holding member can be simplified.

Preferably, the position regulating means may be provided in positions which are shifted from a center of a thickness-wise direction of the male sub-connectors.

With this configuration, since the position regulating means is shifted from the center of the width-wise direction of the male sub-connector, the inverted male sub-connector cannot be inserted into the holding member. For this reason, the inverted sub-connector can be prevented from being inserted previously.

Preferably, the position regulating means is extended along a direction where the male sub-connectors are inserted, and comprises rib sections and groove sections into which the rib sections come, the rib sections and the groove sections being engaged with each other.

Since the position regulating means comprises the rib sections and the groove sections, the structure of the position regulating means can be simplified. Moreover, when the male sub-connector is inserted so that the rib sections come into the groove sections, the male sub-connector can be fixed. Therefore, the male sub-connector can be mounted easily.

Preferably, the connector further comprises latch locking means provided on the outer surfaces of the male sub-connectors and the inner surface of the holding member, and engaged with each other so as to prevent the male sub-connectors from slipping off.

With this configuration, since the latch locking means prevents the male sub-connectors from slipping off, they can be mounted stably.

DETAILED DESCRIPTION OF THE PREFERRED EMBODIMENT

An embodiment of the present invention will be described with reference to the accompanying drawings hereinafter.

Now referring to FIGS. 1 through 5, a connector 11 has a holding member 12, and plural male sub-connectors 13 mounted into the holding member 12.

Figure 2:
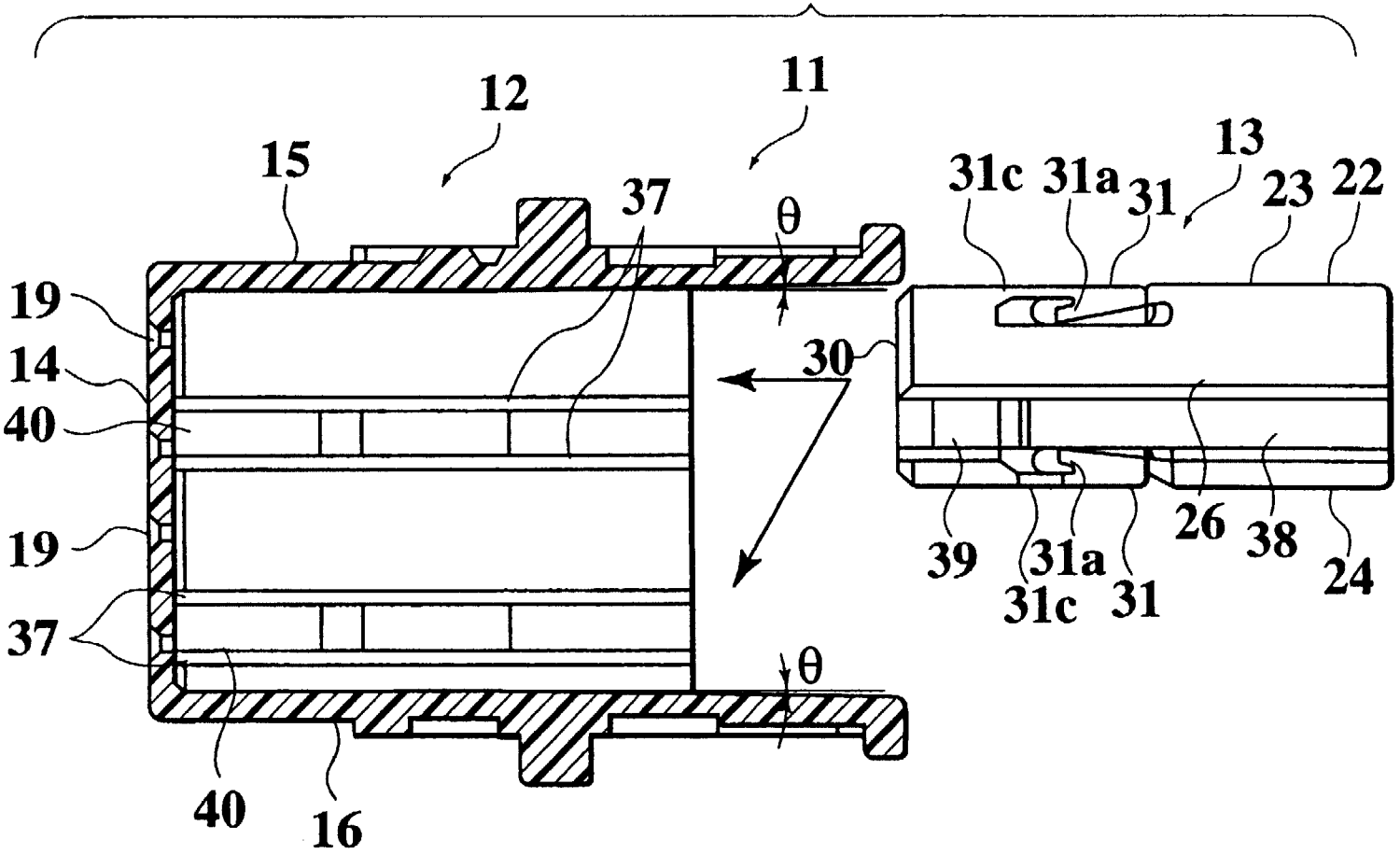
FIG. 2 is a sectional view before the male sub-connectors are inserted into the holding member.

The holding member 12 is surrounded by a front wall 14, an upper wall 15, a lower wall 16 and right and left side walls 17 and 18, and is formed into a rectangular box shape where its back portion is opened. As shown in FIG. 2, tapered mating terminal insertion openings 19 whose diameter becomes larger outward and slantingly are opened on the front wall 14, and mating terminals (not shown) of a mating connector are inserted into the mating terminal insertion openings 19 respectively. Moreover, the mating terminal insertion openings 19 are provided according to terminals 21 mounted to the male sub-connector 13. Here, plural independent terminal housing chambers 20 for directly housing respective terminals are formed on the outer surface of the side wall 18.

Figure 1:
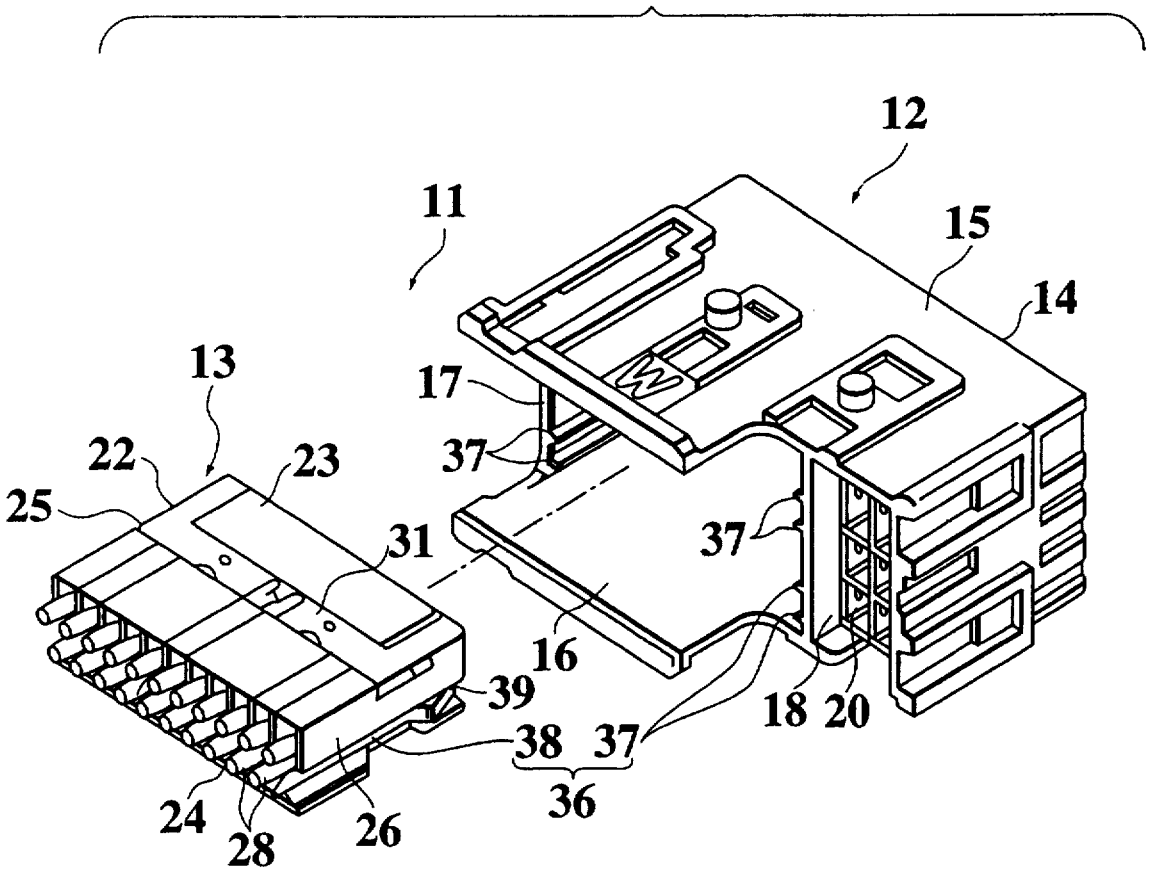
FIG. 1 is a perspective view before male sub-connectors are mounted to a holding member according to one embodiment of the present invention.

The male sub-connector 13 has a connector housing 22 for housing the plural terminals 21 in the upper and lower lines. The whole-shape of the connector housing 22 is rectangular. As shown in FIG. 1, the connector housing 22 has an upper wall 23, a lower wall 24 and right and left side walls 25 and 26, and it has a middle wall 27, which separates the terminals 21 in the upper and lower lines, between the upper wall 23 and the lower wall 24.

In addition, plural partition walls (not shown) are formed between the right and left side walls 25 and 26, and thus portions divided by the partition walls, the middle wall 27 and the right and left side walls 25 and 26 serve as terminal housing chambers 29. The terminal housing chambers 29 are separated in upper and lower lines, and are arranged sideways. The terminal housing chambers 29 are opened at their back portions, and the terminals 21 are housed respectively in the terminal housing chambers 29 from their opened back portions.

Figure 5:
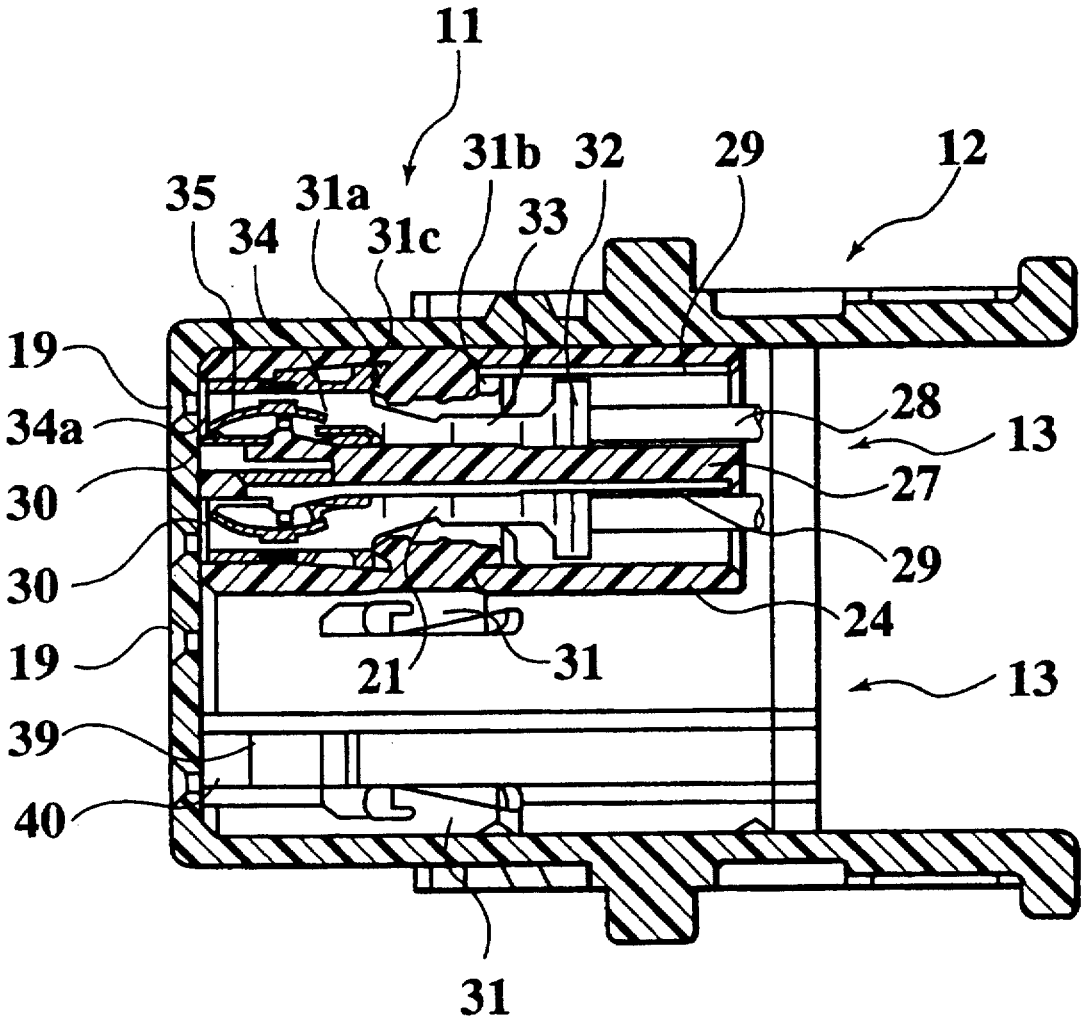
FIG. 5 is a sectional view showing the state that the male sub-connectors are inserted into the holding member.

Further, mating terminal insertion openings 30 corresponding to the terminal housing chambers 29 are opened at the front portion of the connector housing 22. When the male sub-connector 13 is mounted into the holding member 12, the mating terminal insertion openings 30 are interconnected with the mating terminal insertion openings 19 of the holding member 12 as shown in FIG. 5.

In addition, latch members 31 are provided on the male sub-connector 13. The latch members 31 are formed integrally with the upper wall 23 and the lower wall 24 of the connector housing 22. The latch members 31 are formed so that their length is the same as the whole width of the upper wall 23 and the lower wall 24. The latch members 31 have thin hinge sections 31 which are interconnected with the upper wall 23 and the lower wall 24, engagement claw sections 31*a* which are engaged with the terminals 21 in the terminal housing chambers 29, and latch convex sections 31*b* which are latched with the upper wall 23 of the connector housing 23.

The latch members 31 can rise and fall on the connector housing 22 via the hinge sections 31*c*. Before the terminals are inserted into the connector housing 22, the latch members 31 rise from the upper wall 23 and the lower wall 24. After the terminals 21 are inserted into the connector housing 22, when the latch members 31 are revolved in a closing direction, they bare flush with the upper wall 23 and the lower wall 24. Moreover, since the latch convex sections 31*b* are latched with the upper wall 23 by the revolving, revolving in an opening direction is restricted.

When the latch members 31 revolve in the closing direction, the engagement claw sections 31*a* are engaged with back sides of contact sections 34 of the terminals 21. For this reason, the terminals 21 can be fixed securely into the terminal housing chambers 29. In addition, in the case where a tension force is applied to the terminals 21 in a drawn-out direction, the latch members 31 contact with the lower surface of the upper wall 23 of the connector housing 22 and the outer surface of the male sub-connector 13 which is piled in the vertical direction. As a result, the engagement claw sections 31*a* are engaged with the terminals 21 more firmly. For this reason, the terminals 21 are securely prevented from slipping off.

The terminals 21 are inserted into the connector housing 22 of the male sub-connector 13 with them being connected with electric wires 28. The terminals 21 are constituted by interconnecting a caulking section 32 for caulking the insulating coatings of the electric wires 28 so as to fix the electric wires 28, a connection section 33 to be connected with the conductors of the electric wires 28 by caulking and the contact section 34 which is electrically connected with the mating terminals by inserting the mating terminals. The contact section 34 has a tubular shape, and a contact piece 35 which elastically contacts with the mating terminals is provided in the contact section 34. An opening 34*a* at the point of the contact section 34 is interconnected with the mating terminal insertion opening 19 of the holding member 12.

In the present embodiment, position regulating means 36 is provided in the holding member 12 and the male sub-connector 13. The position regulating means 36 is composed of rib sections 37 which are projected horizontally on the inner surfaces of the right and left side walls 17 and 18 in the holding member 12, and groove sections 38 which are formed on the outer surfaces of the right and left side walls 25 and 26 of the male sub-connector 13.

The rib sections 37 are extended along the direction where the male sub-connector 13 is inserted. The two rib sections 37 which face in the vertical direction compose one pair, and the two rib sections 37 face the groove sections 38 of the male sub-connector 13. In the present embodiment, since the male sub-connectors 13 are housed in the upper and lower positions, two pairs of the rib sections 37 are formed respectively on the inner surfaces of the side walls 17 and 18.

The positions where the rib sections 37 are formed are set so that the mating terminal insertion openings 30 of the male sub-connector 13 coincide with the mating terminal insertion openings 19 of the holding member 12. In this case, the rib sections 37 are arranged along a direction where the holding member 12 is drawn out of a metal mold, but the projecting height of the rib sections 37 is set so that a trimming taper should not be formed on the rib sections 37.

The groove sections 38 are formed by depressing the outer surfaces of the right and left side walls 25 and 26 of the connector housing 22 in the male sub-connector 13. The groove sections 38 are extended along the direction where the male sub-connectors 13 are inserted into the holding member 12, and a pair of the ribs 37, which are formed on the inner surface of the holding member 12 come thereinto. As a result, the position of the male sub-connector 13 is regulated so that the mating terminal insertion openings 30 and 19 are interconnected, and the male sub-connector 13 is fixed in the regulated state.

The groove sections 38 are provided in positions which are shifted from or relative to a central axis parallel to a longitudinal direction of the male sub-connector 13. In the embodiment shown in the drawings, the groove sections 38 are provided in the positions below the thickness-wise direction of the male sub-connector 13. As a result, even if the male sub-connectors 13 are attempted to be inserted into the holding member 12 with them being inverted, the rib sections 37 cannot come into the groove sections 38. Therefore, the male sub-connectors 13 cannot be mounted into the holding member. For this reason, the inverted male sub-connectors 13 can be previously prevented from being inserted in an undesired orientation.

In the present embodiment, latch locking means composed of lock convex sections 39 and lock concave sections 40 is provided. The lock convex sections 39 are formed on edge portions of the outer surfaces of the right and left side walls 25 and 26 of the connector housing 22. In the embodiment shown in the drawings, the lock convex sections 39 are provided in the groove sections 38 composing the position regulating means 36.

On the other hand, the lock concave sections 40 are formed on edge portions of the inner surfaces of the right and left side walls 17 and 18 of the holding member 12. The lock convex sections 39 and the lock concave sections 40 are engaged with each other by inserting the male sub-connector 13 into the holding member 12. For this reason, the male sub-connector 13 do not slip off the holding member 12, and the mounting state is stable.

The following will describe the assembly of the present embodiment. As shown in FIG. 1, after the terminals 21 to which the electric wires 28 were mounted are inserted into the terminal housing chambers 29, the latch members 31 are closed as shown in FIG. 2, and the engagement claw sections 31*a* are engaged with the terminals 21. As a result, the terminals 21 are prevented from slipping off.

Figure 3:
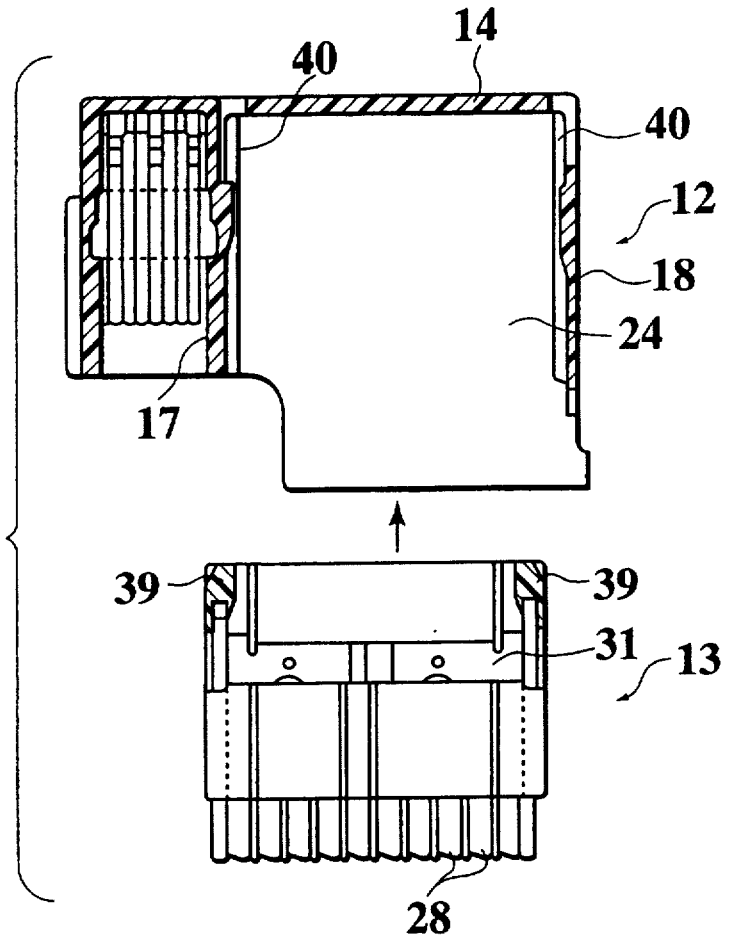
FIG. 3 is a plan view before the male sub-connectors are inserted and it shows assembly of one embodiment.
Figure 4:
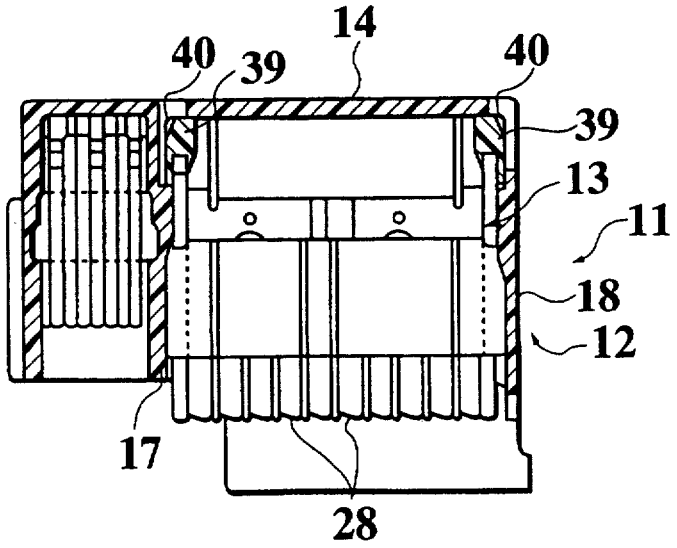
FIG. 4 is a plan view after the male sub-connectors are inserted and it shows assembly of one embodiment.

Then, as shown in FIGS. 2 and 3, the male sub-connectors 13 are inserted into the holding member 12 from its back side. At this time, the rib sections 37 come into the groove sections 38 of the male sub-connectors 13. At the end of the insertion, since the lock convex sections 39 are engaged with the lock concave sections 40 as shown in FIG. 4, the male sub-connector 13 in the slip-off preventing state is fixed to the holding member 12.

In the above embodiment, when the male sub-connector 13 is inserted into the holding member 12, the rib sections 37 come into the groove sections 38, and thus the male sub-connector 13 is fixed to the holding member 12 with the position of the male sub-connector 13 being regulated. For this reason, the male sub-connector 13 becomes stable. At the same time, the rib sections 37 regulate the position of the male sub-connector 13 so that the mating terminal insertion openings 30 and 19 coincide or remain aligned with each other.

As a result, the holding member 12 becomes longer and its depth becomes larger. Even if the angle θ defined by a tapered or inclined wall of the taper trimmed from the metal mold of the holding member 12 (see FIG. 2) becomes larger, the male sub-connector 13 can be stable so that the mating terminal insertion openings 30 and 19 coincide with each other. Therefore, the openings 34*a* at the points of the contact sections 34 of the terminals 21 do not come into, penetrate, or interfere with the diameters of the mating terminal insertion openings 19 of the holding member 12 due to the unstable state, and the mating terminals can be introduced into the contact sections 34 securely. As a result, the mating terminals can contact with the contact sections 34 securely.

In addition, since the rib sections 37 and the groove sections 38 fix the male sub-connector 13 to the holding member 12 in the above manner, the plural male sub-connectors 13 can be fixed to the prescribed positions in the holding member securely. For this reason, even in the case where the male sub-connectors are piled in the vertical direction, it is not necessary to form the partition walls for separating the male sub-connectors 13 in the holding member 12. As a result, the structure of the holding member 12 can be simplified.

Here, according to the present invention, the rib sections 37 may be provided on the outer surface of the male sub-connector 13, and the groove sections 38 may be provided on the inner surface of the holding member 12.

What is claimed is:

1. A connector comprising:

a plurality of male sub-connectors in which terminal housing chambers for housing terminals are formed, each of the plurality of male sub-connectors having a mating terminal insertion opening;

a holding member into which the male sub-connectors are inserted, the holding member having at least one inner wall tapered relative to a longitudinal direction of the holding member and a plurality of terminal insertion openings; and position regulating means configured for regulating positions of said male sub-connectors while said male sub-connectors are inserted along a direction parallel to the longitudinal direction of the holding member and preventing the at least one tapered inner wall from allowing said male sub-connectors to move relative to the longitudinal direction of the holding member so that the mating terminal insertion openings of said male sub-connectors are aligned with respective mating terminal insertion openings of said holding member, said position regulating means being provided on outer surfaces of said male sub-connectors and on an inner surface of said holding member.

2. The connector according to claim 1, wherein said position regulation means is provided in positions which are shifted from a central axis parallel to a longitudinal direction of said male sub-connectors so as to prevent said male sub-connectors from being inserted into the holding member in an undesired orientation.

3. The connector according to claim 1, wherein said position regulating means extends substantially parallel to the longitudinal direction of the holding member and comprises rib and groove sections configured for engaging each other when said male sub-connectors are inserted into the holding member.

4. The connector according to claim 1, wherein said connector further comprises latch locking means provided on the outer surfaces of the male sub-connectors and the inner surface of the holding member, and configured to prevent said male sub-connectors from disengaging from said holding member.

5. The connector of claim 1, wherein said position regulation means is configured to prevent said male sub-connectors from being inserted into the holding member in an undesired orientation.

6. The connector of claim 1, wherein said position regulating means comprises first and second rib sections extending from a front location to a rear location of the holding member and first and second groove sections extending from a front location to a rear location of each of said male sub-connectors so as to prevent said male sub-connectors from moving relative to said longitudinal direction of the holding member while said male sub-connectors are moved between the front and rear locations of said holding member.

7. The connector of claim 1, wherein said position regulating means comprises first and second rib sections extending from a front wall to a rear wall of the holding member and first and second groove sections extending from a front wall to a rear wall of each of said male sub-connectors so as to prevent said male sub-connectors from moving relative to said longitudinal direction of the holding member while said male sub-connectors are moved between the front and rear walls of said holding member.

8. The connector of claim 3, wherein said rib and groove sections are configured for preventing said male sub-connectors from moving relative to the holding member along a direction substantially perpendicular to the longitudinal direction of the holding member when said male sub-connectors are inserted into the holding member.

9. The connector of claim 1, wherein said position regulating means includes at least one groove section extending along a longitudinal direction of each of said male sub-connectors.

10. The connector of claim 9, further comprising a locking means located within the at least one groove section of said position regulating means and configured for preventing said male sub-connectors from separating from said holding member.

11. The connector of claim 9, wherein the locking means includes at least one convex section provided in the at least one groove section of said position regulating means and at least one concave section formed on said inner surface of said holding member.

12. A connector comprising:

at least one male sub-connector having a terminal housing chamber for housing a terminal and a terminal insertion opening;

a holding member configured for receiving the at least one male sub-connector and having at least one inner wall tapered relative to a longitudinal direction of the holding member and at least one terminal insertion openings; and a position guiding structure provided on an outer surface of the male sub-connectors and an inner surface of said holding member for guiding the at least male sub-connector while the at least one male sub-connector is inserted into the holding member along a direction parallel to the longitudinal direction of the holding member and preventing the at least one tapered inner wall of the holding member from allowing the at least one male sub-connector to move relative to the longitudinal direction of the holding member so as to align the terminal insertion opening of the at least one male sub-connector with the at least one terminal insertion opening of the holding member.

13. The connector of claim 12, wherein the position guiding structure is configured to prevent the at least one male sub-connector from being inserted into the holding member in an undesired orientation.

14. The connector of claim 13, wherein the position guiding structure is located at a position spaced from a central axis of the at least one male sub-connector.

15. The connector of claim 12, wherein the position guiding structure extends substantially parallel to the longitudinal direction of the holding member and comprises rib and groove sections configured for engaging each other when the at least one male sub-connector is inserted into the holding member.

16. The connector of claim 12, wherein said connector further comprises a latch locking device provided on the outer surface of the at least one male sub-connector and on the inner surface of the holding member and configured to prevent said male sub-connectors from disengaging from said holding member.

17. The connector of claim 12, wherein the position guiding structure comprises first and second rib sections extending between front and rear locations of the holding member and first and second groove sections extending between front and rear locations of the at least one male sub-connector so as to prevent the at least one male sub-connector from moving relative to the longitudinal direction of the holding member while the at least one male sub-connectors is moved between the front and rear locations of the holding member.

18. The connector of claim 12, wherein the position guiding device includes at least one groove section extending along a longitudinal direction of the at least one male sub-connector.

19. The connector of claim 18, further comprising a locking device located within the at least one groove section of the position guiding structure and configured for preventing the at least one male sub-connector from separating from the holding member.

20. The connector of claim 19, wherein the locking device includes a convex section provided in the at least one groove section of the position guiding structure and at least one concave section formed on the inner surface of the holding member.

* * * * *

UNITED STATES PATENT AND TRADEMARK OFFICE

CERTIFICATE OF CORRECTION

PATENT NO. : 6,179,670 B1
DATED : January 30, 2001
INVENTOR(S) : Osamu Sugiyama

It is certified that error appears in the above-identified patent and that said Letters Patent is hereby corrected as shown below:

Column 8, claim 12,
Lines 8-9, "openings" should read -- opening --.

Column 8, claim 17,
Lines 49-50, "sub-connectors" should read -- sub-connector --.

Signed and Sealed this

Ninth Day of April, 2002

*Attest:*

*Attesting Officer*

JAMES E. ROGAN
*Director of the United States Patent and Trademark Office*